US006876340B2

(12) United States Patent
Kobayashi

(10) Patent No.: US 6,876,340 B2
(45) Date of Patent: Apr. 5, 2005

(54) PLASMA DISPLAY PANEL AND METHOD OF DRIVING SAME

(75) Inventor: Kenichi Kobayashi, Yamanashi-ken (JP)

(73) Assignees: Pioneer Corporation, Tokyo (JP); Snizuoka Pioneer Corporation, Snizuoka-ken (JP)

( * ) Notice: Subject to any disclaimer, the term of this patent is extended or adjusted under 35 U.S.C. 154(b) by 345 days.

(21) Appl. No.: 10/278,079

(22) Filed: Oct. 23, 2002

(65) Prior Publication Data

US 2003/0090443 A1 May 15, 2003

(30) Foreign Application Priority Data

Nov. 9, 2001 (JP) ..... 2001-344070

(51) Int. Cl.[7] ..... G09G 3/28

(52) U.S. Cl. ..... 345/60; 313/585; 313/584; 313/582; 313/587

(58) Field of Search ..... 313/585, 584, 313/587; 345/60

(56) References Cited

U.S. PATENT DOCUMENTS 6,674,238 B2 * 1/2004 Otani et al. ..... 313/587
6,703,782 B2 * 3/2004 Otani et al. ..... 313/585

* cited by examiner

*Primary Examiner*—Dennis-Doon Chow
*Assistant Examiner*—Ming-Hun Liu
(74) *Attorney, Agent, or Firm*—Arent Fox

(57) ABSTRACT

A plasma display panel comprises a selective row electrode Z extending between row electrode pairs (X, Y) adjacent to each other in a column direction. A discharge cell is divided by into two by a second transverse wall 15B of a partition wall 15 defining the periphery of the discharge cell: a display discharge cell C1 provided opposite transparent electrodes Xa, Ya of the paired row electrodes X, Y for a sustaining discharge, and a reset and addressing discharge cell C2 provided opposite the selective row electrode Z for a reset discharge and an addressing discharge which are created between the electrode Z and a column electrode D. A clearance r is provided for communication between the display discharge cell C1 and the reset and addressing discharge cell C2.

10 Claims, 14 Drawing Sheets

V1-V1 SECTION

V1-V1 SECTION

W1-W1 SECTION

W2-W2 SECTION

V2-V2 SECTION

W3-W3 SECTION

V—V SECTION

W—W SECTION

PLASMA DISPLAY PANEL AND METHOD OF DRIVING SAME

BACKGROUND OF THE INVENTION

1. Field of the Invention

This invention relates to a panel structure of a surface-discharge-type alternating-current plasma display panel and a method of driving the plasma display panel.

The present application claims priority from Japanese Application No. 2001-344070, the disclosure of which is incorporated herein by reference for all purposes.

2. Description of the Related Art

Recently, surface-discharge-type alternating-current plasma display panels have gained the spotlight as an oversized and slim display for color screen, and directed toward widespread use in ordinary homes and the like.

FIG. 14 to FIG. 16 are schematic views of a construction of a surface-discharge-type alternating-current plasma display panel in prior art, in which FIG. 14 is a front view of the surface-discharge-type AC plasma display panel, FIG. 15 is a sectional view taken along the V—V line of FIG. 14, and FIG. 16 is a sectional view taken along the W—W line of FIG. 14.

In FIGS. 14 to 16, the plasma display panel (hereinafter referred to as "PDP") includes a front glass substrate 1, serving as the display surface of the PDP, having on its back surface, in order, a plurality of row electrode pairs (X', Y'), a dielectric layer 2 covering the row electrode pairs (X', Y'), and a protective layer 3 made of MgO and covering the back surfaces of the dielectric layer 2.

Each of the row electrodes X', Y' is constructed of a transparent electrode Xa', Ya' which is formed of a transparent conductive film with a larger width made of ITO or the like, and a bus electrode Xb', Yb' which is formed of a metal film with a smaller width assisting the electrical conductivity of the corresponding transparent electrode.

The row electrodes X' and Y' are arranged in alternate positions in the column direction such that the electrodes X' and Y' of each pair (X', Y') face each other with a discharge gap g' in between. Each of the row electrode pairs (X', Y') forms a display line (row) L in the matrix display.

The front glass substrate 1 is situated opposite a back glass substrate 4 with a discharge-gas-filled discharge space S' interposed between the substrates 1 and 4. The back glass substrate 4 is provided thereon with: a plurality of column electrodes D' which are regularly arranged and each extend in a direction at right angles to the row electrode pair (X', Y'); band-shaped partition walls 5 each extending in parallel to and between adjacent column electrodes D'; and phosphor layers 6 formed of phosphor materials of a red color, green color, and blue color, each of which covers the column electrode D' and the side faces of the partition walls 5.

In each display line L, the partition walls 5 partition the discharge space S' into areas each corresponding to an intersection of the column electrode D' and the row electrode pair (X', Y'), to define discharge cells C' which are unit light-emitting areas.

Such surface-discharge-type alternating-current PDP generates images through the following procedure.

First, in an addressing period following a reset period for generating a reset discharge, a discharge (an addressing discharge) is selectively generated between one row electrode of each electrode pair (X', Y') (the row electrode Y' in this example) and the column electrode D' in each of the discharge cells C'. With occurrence of the addressing discharge, lighted cells (the discharge cell in which wall charges are generated on the dielectric layer 2) and non-lighted cells (the discharge cell in which wall charges are not generated on the dielectric layer 2) are distributed over the panel surface in accordance with an image to be displayed.

After completion of the addressing period, a discharge sustaining pulse is applied alternately to the row electrodes X' and Y' of each row electrode pair simultaneously in each display line L. Every time the discharge sustaining pulse is applied, a sustaining discharge is caused between the row electrodes X' and Y' in each lighted cell by means of the wall charges formed on the dielectric layer 2.

Ultraviolet light is generated by the sustaining discharge in each lighted cell, which then excites the red, green or blue phosphor layer 6 in each discharge cell C' to thereby form a display image.

In the prior art three-electrode surface-discharge-type alternating-current PDP having the construction as mentioned above, an addressing discharge and a sustaining discharge are produced in the same discharge cell C'. That is, the addressing discharge occurs within the discharge cell C' incorporating a red, green or blue color-applied phosphor layer 6 provided for emitting color light upon creation of the sustaining discharge.

Due to this interposition of the phosphor layer, the addressing discharge created in the discharge cell C' is subject to various influences ascribable to the phosphor layer 6, such as discharge properties differing among phosphor materials of three colors forming the phosphor layer 6, variations in layer thickness produced in a step of forming the phosphor layer 6 in the manufacturing process of the PDP, and the like.

Hence, the prior art PDPs have a significantly difficult problem for obtaining equal addressing discharge properties in each discharge cell C'.

The three-electrode surface-discharge-type AC PDP as described above needs a large discharge space in each discharge cell C' in order to increase the luminous efficiency. Therefore, the prior art typically adopts a manner of increasing the height of the partition wall 5.

However, if the partition wall 5 is increased in height for an increase of the luminous efficiency, the interval between the row electrode Y' and the column electrode D' between which the addressing discharge is caused is also increased. This gives rise to a problem of an increase of a starting voltage for the addressing discharge.

Further, the prior art three-electrode surface-discharge-type AC PDP as described above typically has a configuration in which a reset discharge, an addressing discharge and a sustain discharge are caused by the same row electrode (the row electrode Y' in this example) and therefore a reset pulse for initiating the reset discharge, a scan pulse (select pulse) for initiating the addressing discharge and a discharge sustaining pulse for initiating the sustaining discharge are applied to the same row electrode Y', so that a discharge current for the discharge sustaining pulse is output by using a driver for generating the scan pulse.

This configuration disadvantageously means that, in order to reduce current loss, a high-performance scan-pulse generation driver must be used. The use of the high-performance scan-pulse generation driver increases heating values of the PDP, which therefore requires a panel construction with a high capacity to dissipate heat.

Still further, the prior art PDP as described above has another problem of requiring an extra high-performance switch circuit for isolating a reset-pulse generation circuit from a sustaining-pulse generation circuit.

SUMMARY OF THE INVENTION

The present invention has been made to solve the problems associated with the prior art surface-discharge-type alternating-current plasma display panels as described above.

Accordingly, it is a first object of the present invention to provide a plasma display panel enhanced in luminous efficiency and stabilization of addressing discharge properties in each discharge cell and realizing simplified configuration of a driving circuit for cost reduction.

It is a second object of the present invention to provide a method of driving the plasma display panel attaining the first object.

To attain the first object, the present invention provides a plasma display panel including: a front substrate; a back substrates opposite the front substrate with a discharge space interposed therebetween; a plurality of row electrode pairs regularly arranged in a column direction on a back surface of the front substrate, and each extending in a row direction to form a display line and being constituted by two row electrodes; a dielectric layer covering the row electrode pairs on the back surface of the front substrate; and a plurality of column electrodes regularly arranged in the row direction on a surface of the back substrate facing the front substrate, and each extending in the column direction to intersect the row electrode pairs and form unit light-emitting areas in the discharge space at the respective intersections. The plasma display panel according to a first feature of the present invention comprises: a selective row electrode extending in the row direction in a position between the row electrode pairs adjacent to each other in the column direction on the back surface of the front substrate; a partition wall surrounding each of the unit light-emitting areas to define the unit light-emitting areas; a dividing wall provided for dividing each of the unit light-emitting areas into a first discharge area provided opposite face-to-face parts of the respective row electrodes constituting each row electrode pair for a discharge to be caused between the row electrodes, and a second discharge area provided opposite a portion of the selective row electrode intersecting with the column electrode for a discharge to be caused between the selective row electrode and the column electrode; and a communication element provided between the first discharge area and the second discharge area for communication from the second discharge area to the first discharge area.

In the plasma display panel in the first feature, for generating an image, an addressing discharge is produced between the column electrode and the selective row electrode, which are opposite each other with the interposed second discharge area, within a second discharge area of each of the unit light-emitting areas selected in response to a video signal. Then, charged particles generated during the addressing discharge caused to flow from the second discharge area into a first discharge area (the first and second discharge areas forming a unit light-emitting area and divided from each other by the dividing wall in the unit light-emitting area) via the communicating element provided between the first and second discharge areas. Thus, the unit light-emitting areas having wall charges formed on a portion of the dielectric layer facing the first discharge area, and the unit light-emitting areas having no wall charges formed thereon are distributed over the panel surface in accordance with the image to be generated.

After that, in each of the first discharge areas of the unit light-emitting areas having the wall charges formed therein, a sustaining discharge is caused between the opposite parts of the respective row electrodes of each row electrode pair for light emission. Ultraviolet light generated by the sustaining discharge excites a phosphor layer of one of the three primary colors red, green and blue formed in each first discharge area to allow it to emit color light to form the image on the panel surface in accordance with an image signal.

In the plasma display panel of the first feature, it is also possible to produce a reset discharge between the selective row electrode and the column electrode within the second discharge area, for formation of wall charges on the portions of the dielectric layer facing the first discharge areas of all of the unit light-emitting areas or for removal of wall charges existing thereon.

In this way, the first feature is designed such that, in order to distribute the unit light-emitting areas generating light emission and the unit light-emitting areas generating no light emission over the panel surface in accordance with a video signal, the addressing discharge occurs in the second discharge area which is divided from the first discharge area, provided for light emission, in each unit light-emitting area by the dividing wall. In addition, the addressing discharge is created between the column electrode and the selective electrode provided independently of the row electrode pair. This design according to the first feature eliminates the need for using a scan-pulse generation driver for an addressing discharge to output a discharge sustaining pulse as in cases of prior art PDPs of using the same row electrode for both an addressing discharge and a sustaining discharge.

Consequently, the need for using a high-performance scan-pulse generation driver is eliminated. In turn, a heat-dissipating panel construction required in use of the high-performance scan-pulse generation driver becomes also unnecessary. Further, a manner of creating a reset discharge between the column electrode and the selective row electrode within the second discharge area eliminates the need for providing a high-performance switch circuit for separating a reset-pulse generation circuit from a discharge-sustaining-pulse generation circuit. Thus, the configuration of the driving circuit and the panel construction are successfully simplified, leading to cost reduction.

To attain the first object, the plasma display panel according to a second feature comprises, in addition to the configuration of the first feature, a black- or dark-colored light absorption layer provided on a portion of the front substrate opposite each of the second discharge areas.

With the plasma display panel of the second feature, a face of the second discharge area on the front substrate side, or on the display screen side, is fully covered with the black- or dark-colored light absorption layer. The light absorption layer prevents the light generated by the discharge between the column and selective row electrode within the second discharge area from leaking toward the display surface of the panel, and consequently from having an adverse effect on an image formed on the panel display surface. The light absorption layer also prevents the reflection of ambient light incident upon an area of the display surface of the panel opposite the second discharge area, thereby eliminating the likelihood of an adverse effect upon the contrast in the image.

To attain the first object, the plasma display panel according to a third feature comprises, in addition to the configuration of the first feature, a phosphor layer provided only in each of the first discharge areas for emitting light by means of the discharge.

With the plasma display panel of the third feature, a phosphor layer for emitting light by means of the discharge is not provided in the second discharge area experiencing the reset discharge and addressing discharge between the selective row electrode and the column electrode. Hence, the reset discharge or the addressing discharge in the second discharge area is not subject to the disadvantageous influences of differences in discharge properties produced by phosphor materials in the three primary colors forming the phosphor layers and variations in the thickness of the phosphor layers, thus achieving the stabilization of the discharge properties of the reset discharge and addressing discharge in the second discharge area.

To attain the first object, the plasma display panel according to a fourth feature has, in addition to the configuration of the first feature, a configuration that the communication element comprises a clearance formed between the front substrate and the dividing wall by determining a height of the dividing wall dividing off the first discharge area and the second discharge area to be less than a height of the partition wall for defining the periphery of each unit light-emitting area.

With the plasma display panel of the fourth feature, even when a partition wall for defining the periphery of each unit light-emitting area is in contact with a part of a dielectric layer or the like provided on the front substrate to block adjacent unit light-emitting areas from each other, since the communication element is provided by the clearance formed between the dividing wall (this wall having a height less than that of the partition wall and dividing off the first discharge area and the second discharge area) and a part of the dielectric layer or the like provided on the front substrate, the charged particles generated in the second discharge area by means of the discharge are allowed to pass through the communicating element to flow into the first discharge area.

To attain the first object, the plasma display panel according to a fifth feature has, in addition to the configuration of the first feature, a configuration that the communication element comprises a groove formed in the dividing wall dividing off the first discharge area and the second discharge area, and having both ends opening toward the first discharge area and the second discharge area.

With the plasma display panel of the fifth feature, even when a partition wall for defining the periphery of each unit light-emitting area is in contact with a part of the dielectric layer or the like provided on the front substrate to block adjacent unit light-emitting areas from each other, the communication element constructed of the groove formed in the dividing wall dividing off the first and second discharge areas permits communication from the second discharge area to the first discharge area. Hence, the charged particles caused by the discharge in the second discharge area pass through the communication element to flow into the first discharge area.

To attain the first object, the plasma display panel according to a sixth feature, in addition to the configuration of the first feature, has a configuration that the partition wall comprises transverse walls and vertical walls, and comprises additional elements jutting out from portions of the dielectric layer opposite the transverse wall for a partition between the adjacent unit light-emitting areas in the column direction and the vertical wall for a partition between the adjacent unit light-emitting areas in the row direction, toward the discharge space to come in contact with the transverse wall and the vertical wall of the partition wall in the vicinity of at least the second discharge area of each unit light-emitting area to block the second discharge area concerned from a adjacent unit light-emitting area adjacent thereto.

In the plasma display panel of the sixth feature, the additional elements formed on at least the portions of the dielectric layer opposite the transverse wall and vertical wall of the partition wall are respectively in contact with the transverse wall and vertical wall concerned which are provided for dividing off at least the second discharge area of each of the unit light-emitting areas from an adjacent unit light-emitting area in the row and column directions. At least the second discharge area is thus blocked completely from the unit light-emitting areas adjacent thereto in the row and column directions. This design allows charged particles caused by a discharge between the selective row electrode and the column electrode within a second discharge area to flow only into a first discharge area, forming the same unit light-emitting area in conjunction with the second discharge area, via the communication element formed in the dividing part between the second discharge area and the first discharge area.

As a result, there is no likelihood that a discharge occurring within the second discharge area has an influence upon the unit light-emitting areas adjacent to the second discharge area concerned in the row and column directions.

To attain the first object, the plasma display panel according to a seventh feature comprises, in addition to the configuration of the first feature, a protrusion element provided between the back substrate and the column electrode and protruding from a portion of the back substrate facing to the second discharge area into the second discharge area in the direction of the front substrate, to allow a part of the column electrode opposite the second discharge area to jut out in the direction of the selective row electrode formed on the front substrate.

With the plasma display panel of the seventh embodiment, inside each of the second discharge areas, the column electrode is raised from the back substrate by the protrusion element formed between the back substrate and the column electrode to be located closer to the selective row electrode opposite the part of the column electrode, placed on the protrusion element concerned, with the second discharge area interposed between the selective row electrode and the column electrode.

The protrusion element provided in this manner effects a reduction in a discharge distance between the column electrode and the selective row electrode in the second discharge area. Accordingly, the present invention achieves a reduction in a discharge starting voltage by means of the shortened discharge distance between the column electrode and the selective row electrode in each of the second discharge areas without decreasing the size of the discharge space in the first discharge area.

To attain the first object, the plasma display panel according to an eighth feature has, in addition to the configuration of the first feature, a configuration that the selective row electrode is formed on a portion of the back surface, facing the second discharge area, of the dielectric layer covering the row electrode pairs.

With the plasma display panel of the eighth feature, the selective row electrode is formed on a portion of the back surface, facing the second discharge area, of the dielectric layer covering the row electrode pairs, and therefore it is located in a position closer to the discharge space as compared with a distance from the row electrode pair formed between the front substrate and the dielectric layer to the discharge space. Because of this location, a discharge distance is decreased between the selective row electrode and the column electrode in the second discharge area, to reduce a starting voltage for the discharge between the electrodes concerned.

To attain the second object, the present invention provides a method of driving a plasma display panel including: a plurality of row electrode pairs regularly arranged on a back surface of a front substrate in a column direction and each extending in a row direction to form a display line; a dielectric layer covering the row electrode pairs on the back surface of the front substrate; a selective row electrode provided between the row electrode pairs adjacent to each other in the column direction on the back surface of the front substrate and extending in the row direction; a plurality of column electrodes regularly arranged in the row direction on a surface of a back substrate facing the front substrate with a discharge space in between, and each extending in the column direction to intersect the row electrode pairs and form unit light-emitting areas in the discharge space at the respective intersections; a partition wall provided around each of the unit light-emitting areas to define the unit light-emitting areas; a dividing wall provided for dividing each of the unit light-emitting areas into a first discharge area provided opposite face-to-face parts of the respective row electrodes constituting each of the row electrode pairs for a discharge caused between the row electrodes, and a second discharge area provided opposite a portion of the selective row electrode intersecting with the column electrode for a discharge caused between the selective row electrode and the column electrode; and a communication element provided between the first discharge area and the second discharge area for communication from the second discharge area to the first discharge area. According to a ninth feature of the present invention, the method of driving the plasma display panel comprises the steps of: selectively causing an addressing discharge between the selective row electrode and the column electrode within the second discharge area to cause charged particles to form wall charges on the dielectric layer or to erase wall charges existing on the dielectric layer; and causing a sustaining discharge between the row electrode pair within the first discharge area for light emission after the charged particles generated by creating the addressing discharge within the second discharge area are introduced through the communication element into the first discharge area to form the wall charges on a portion of the dielectric layer facing the first discharge area or to erase the wall charges existing thereon.

In the method of driving the plasma display panel of the ninth feature, in order to distribute the unit light-emitting area shaving wall charges formed on the portion of the dielectric layer facing the first discharge area by charged particles caused by a discharge (lighted cells), and the unit light-emitting areas having no wall charges formed thereon (no-lighted cells) over the panel surface, an addressing discharge is produced between the column electrode and the selective row electrode, which are opposite to each other with the interposition of the second discharge area, within the second discharge area of each of the unit light-emitting areas selected in response to a video signal.

The charged particles caused by the addressing discharge pass through the communication element provided between the second discharge area and first discharge area, which constitute a unit light-emitting area and divided from each other by the dividing wall, to flow into the first discharge area. Thus, wall charges are formed on the portion of the dielectric layer facing the first discharge area. Alternatively, wall charges existing on the dielectric layer are erased.

After completion of the addressing discharge, in each of the first discharge areas of the unit light-emitting areas having the wall charges formed therein, a sustaining discharge is generated between the opposite parts of the respective row electrodes constituting each row electrode pair for light emission. Ultraviolet light generated by the sustaining discharge excites a phosphor layer of one of the three primary colors red, green and blue formed in the first discharge area to allow the phosphor layer to emit of color light to form the image in accordance with an image signal on the panel surface.

In this manner, for distributing the unit light-emitting areas generating light emission and the unit light-emitting areas generating no light emission over the panel surface in accordance with a video signal, the addressing discharge is created in the second discharge area divided from the first discharge area, provided for light emission, in each unit light-emitting area by the dividing wall. In addition, the addressing discharge is created by using the column electrode and the selective electrode provided independently of the row electrode pair.

Thus, the method according to the ninth feature accomplishes the elimination of the need for using a scan-pulse generation driver for an addressing discharge to output a discharge sustaining pulse as in the cases of prior art PDPs of using the same row electrode for both an addressing discharge and a sustaining discharge.

Consequently, the need for using a high-performance scan-pulse generation driver is eliminated. In turn, a heat-dissipating panel construction required in use of the high-performance scan-pulse generation driver is also unnecessary. Thus, the configuration of the driving circuit and the panel construction are successfully simplified, leading to cost reduction.

To attain the second object, the method of driving the plasma display panel according to a tenth feature comprises, in addition to the configuration of the ninth feature, the step of causing a reset discharge between the selective row electrode and the column electrode in each of the second discharge areas to cause charged particles to form wall charges on the dielectric layer or to erase wall charges existing on the dielectric layer, and has the configuration wherein the addressing discharge is produced in the second discharge after the charged particles generated in the second discharge area by creating the reset discharge are introduced into the first discharge area through the communication element to form the wall charges on a portion of the dielectric layer facing the first discharge area concerned or to erase the wall charges existing thereon.

In the method of driving the plasma display panel of the tenth feature, prior to the addressing discharge, the reset discharge is produced between the selective row electrode and the column electrode, which are opposite to each other with the interposed second discharge area, within the second discharge area in order to form wall charges on the portion of the dielectric layer facing the first discharge area of each of the unit light-emitting areas or to erase wall charges existing thereon.

The charged particles caused by the reset discharge pass through the communicating element provided between the second discharge area the first discharge areas, which constitute each unit light-emitting area and are divided from each other by the dividing wall, to flow into the first discharge area. Thus, the wall charges are formed on the portion of the dielectric layer facing the first discharge area or the wall charges existing thereon are erased.

After completion of the reset discharge, the addressing discharge is caused in each of the second discharge areas of the unit light-emitting areas selected in response to the video signal, in order to distribute the unit light-emitting areas having the wall charges formed on the portion of the dielectric layer facing the first discharge area (the lighted cells) and the unit light-emitting areas having no wall charges formed (the non-lighted cells) over the panel surface.

The driving method according to the present invention as described above eliminates the need for providing a high-performance switch circuit for separating a reset-pulse generation circuit for a reset discharge from a discharge-sustaining-pulse generation circuit for a sustaining discharge. Thus, the configuration of the driving circuit is successfully simplified to accomplish cost reduction of the products.

These and other objects and advantages of the present invention will become obvious to those skilled in the art upon review of the following description, the accompanying drawings and appended claims.

DETAILED DESCRIPTION OF THE PREFERRED EMBODIMENTS

Preferred embodiments according to the present invention will be described below in detail with reference to the accompanying drawings.

Figure 1:
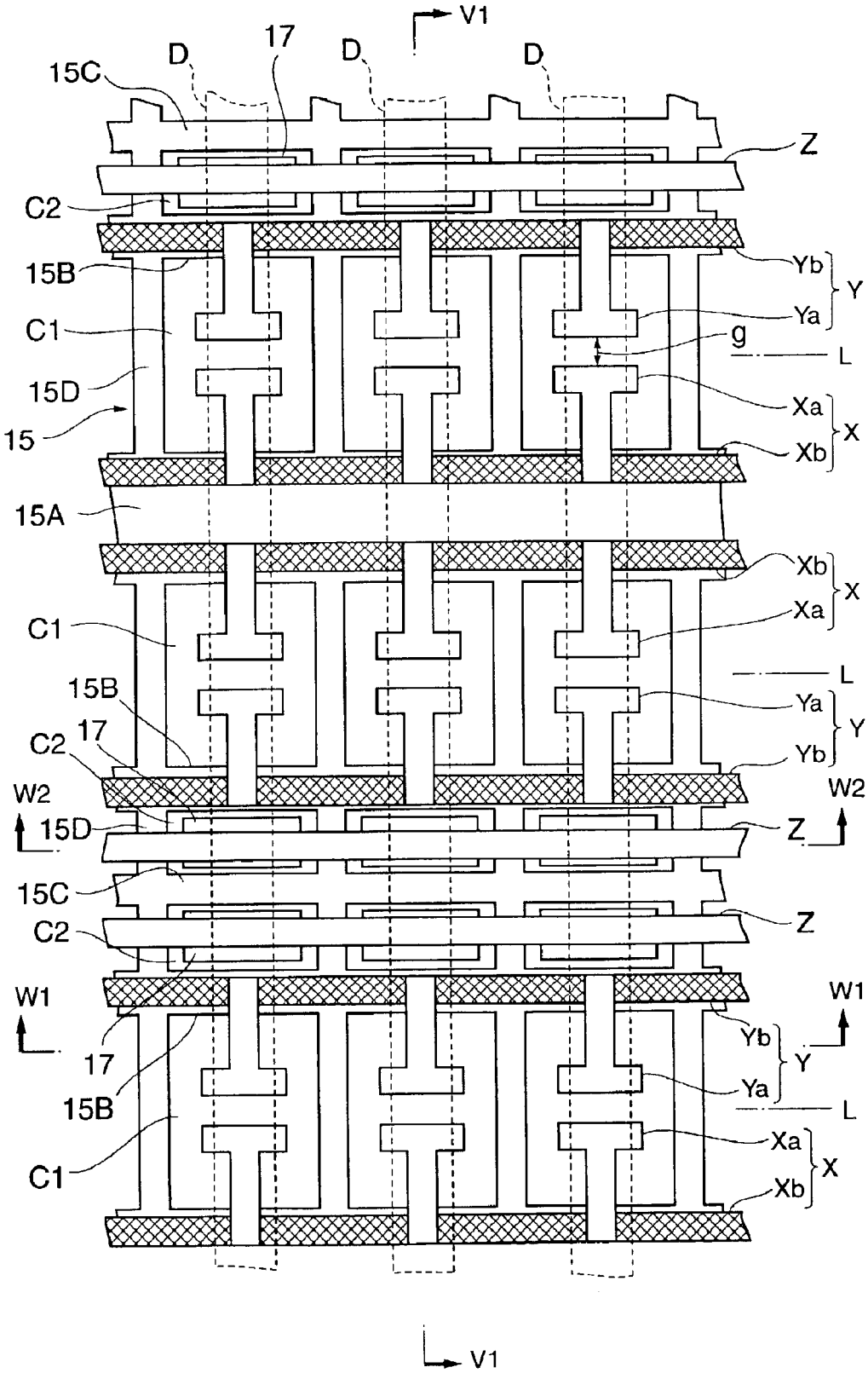
FIG. 1 is a schematic front view of a first embodiment according to the present invention.
Figure 2:
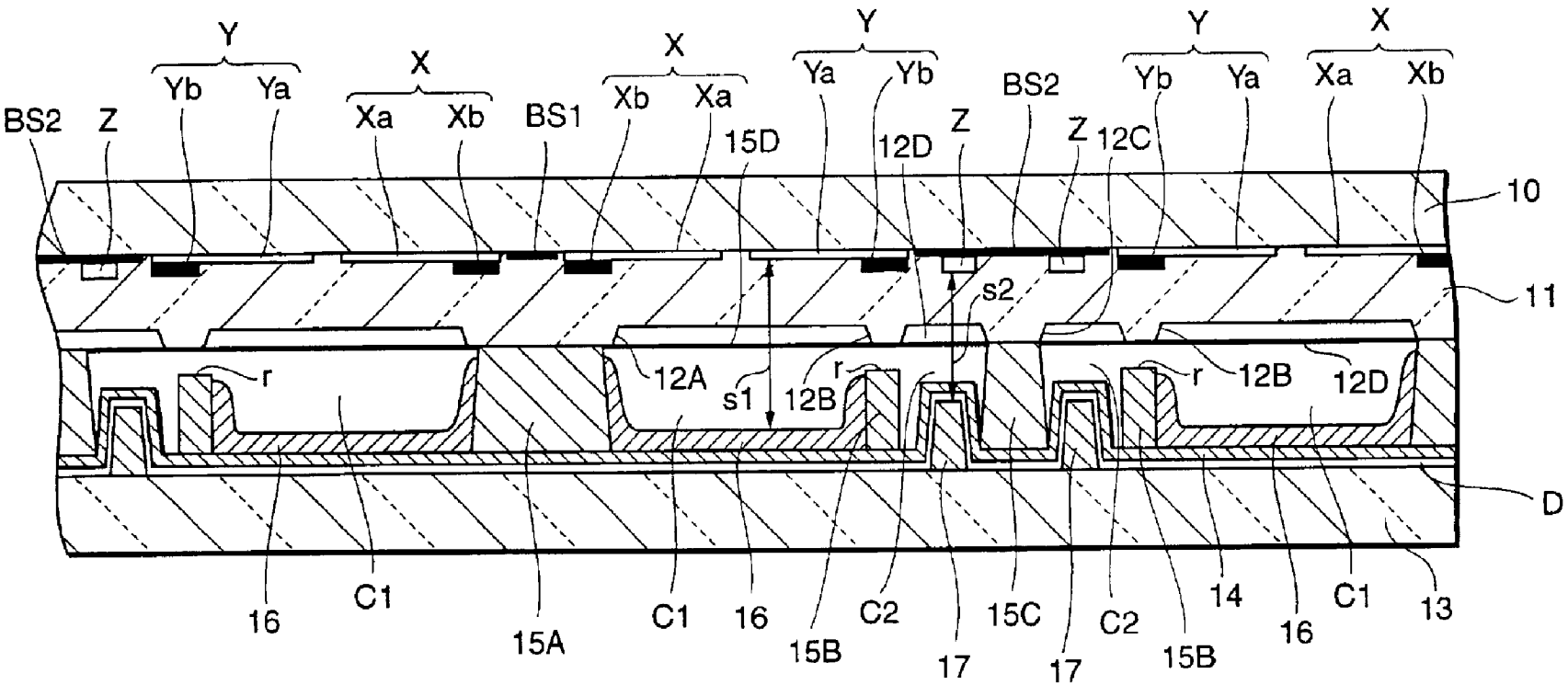
FIG. 2 is a sectional view taken along the V1—V1 line in FIG. 1.
Figure 3:
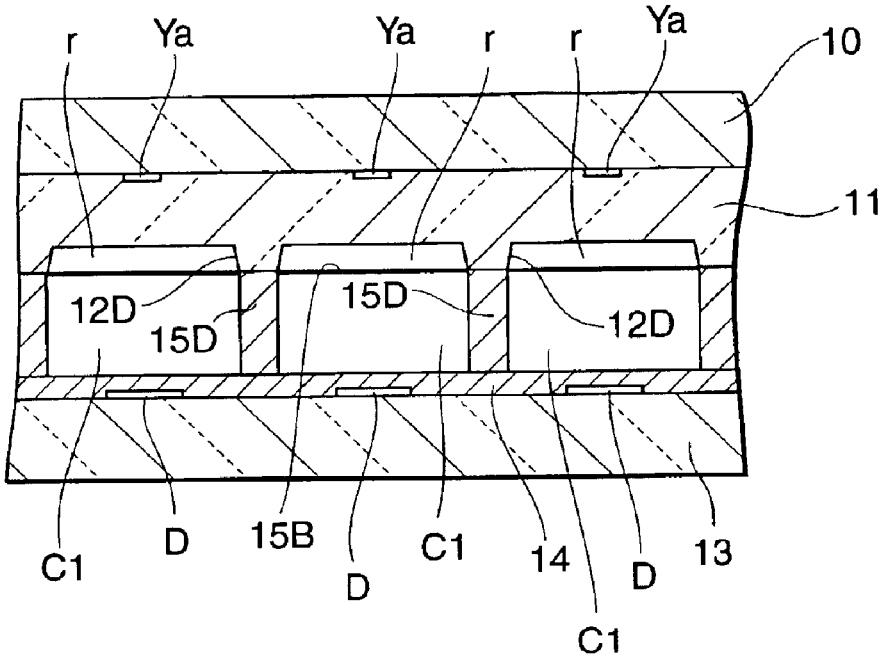
FIG. 3 is a sectional view taken along the W1—W1 line in FIG. 1.
Figure 4:
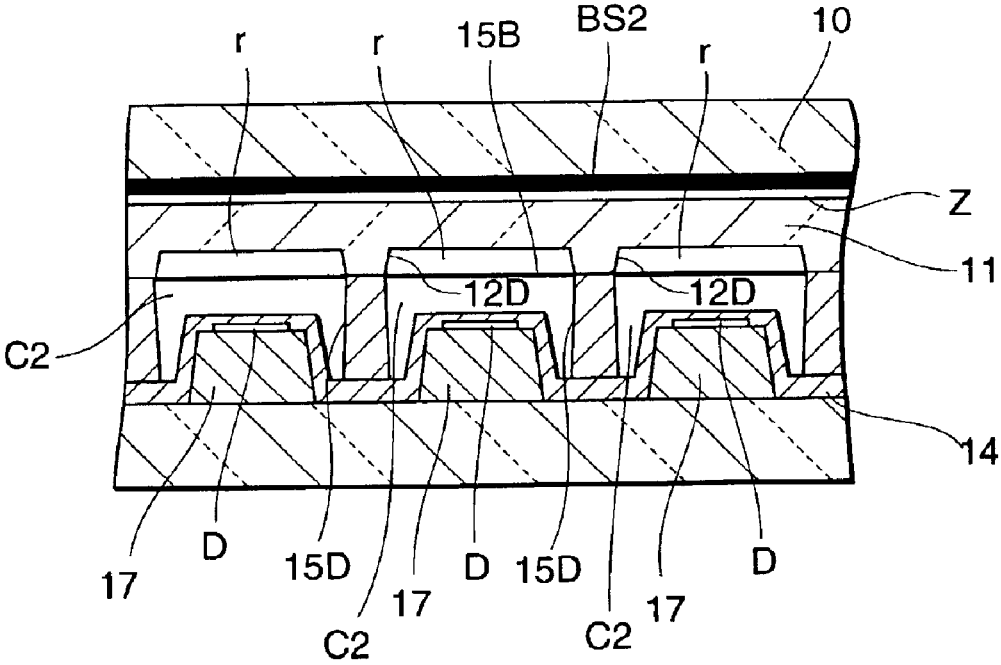
FIG. 4 is a sectional view taken along the W2—W2 line in FIG. 1.

FIG. 1 to FIG. 4 are schematic views illustrating a first embodiment of a plasma display panel (hereinafter referred to as "PDP") according to the present invention, FIG. 1 being a front view of part of the cell construction of the PDP, FIG. 2 being a sectional view taken along the V1—V1 line of FIG. 1, FIG. 3 being a sectional view taken along the W1—W1 line of FIG. 1, and FIG. 4 being a sectional view taken along the W2—W2 line of FIG. 1.

The PDP illustrated in FIGS. 1 to 4 includes a plurality of row electrode pairs (X, Y) arranged in parallel on a back surface of a front glass substrate 10 serving as a display surface and each extending in a row direction of the substrate 10 (in the right-left direction of FIG. 1).

Each of the row electrodes X includes transparent electrodes Xa each of which is formed of a T-shaped transparent conductive film made of ITO or the like, and a black bus electrode Xb which is formed of a metal film extending in the row direction of the front glass substrate 10 and connected to a narrowed base end of each transparent electrode Xa.

Likewise, each of the row electrodes Y includes transparent electrodes Ya each of which is formed of a T-shaped transparent conductive film made of ITO or the like, and a black bus electrode Yb which is formed of a metal film extending in the row direction of the front glass substrate 10 and connected to a narrowed base end of the transparent electrode Ya.

The row electrodes X and Y are arranged in a face-to-face position in a column direction of the front glass substrate 10 (the vertical direction in FIG. 1, and the right-left direction in FIG. 2). The transparent electrodes Xa and Ya are arranged at regular intervals along the corresponding bus electrodes Xb an Yb. Each of the paired transparent electrodes Xa and Ya extends in the direction of the other of the paired row electrodes such that widened leading ends of the respective paired transparent electrodes Xa and Ya are opposite to each other with the inter position of a discharge gap g having a required width.

Each of the row electrode pairs (X, Y) forms a display line L extending in the row direction.

The row electrodes X and Y arranged in the column direction are changed in position in each display line such as in the manner (X-Y), (Y-X), (X-Y), . . . .

The row electrode pairs (X, Y) are arranged such that spacing between the back-to-back positioned row electrodes X of the row electrode pairs (X, Y) adjacent to each other in the column direction is less than spacing between the back-to-back positioned row electrodes Y of the adjacent row electrode pairs (X, Y).

Between the back-to-back positioned row electrodes X of the respective row electrode pairs (X, Y) adjacent to each other in the column direction, a black- or dark-colored light absorption layer BS1 extends in a band shape in the row direction on the back surface of the front glass substrate 10. Likewise, between the back-to-back row electrodes Y, a black- or dark-colored light absorption layer BS2 extends in a band shape in the row direction on the back surface of the front glass substrate 10.

On the back surface of the light absorption layer BS2, two selective row electrodes Z extend in the row direction in parallel to each other at a predetermined interval. Each of the electrodes Z is spaced from the row electrode Y adjacent thereto at a predetermined interval.

On the back surface of the front glass substrate 10, a dielectric layer 11 is formed so as to cover the row electrode pairs (X, Y), the selective row electrodes Z, the light absorption layers BS1 and the light absorption layers BS2.

A first additional dielectric layer 12A extends in parallel to the row direction on the back surface of the dielectric layer 11 and protrudes backward from the back surface of the dielectric layer 11 (downward in FIG. 2) in a position opposite to the bus electrodes Xb of the back-to-back row electrodes X of the adjacent row electrodes (X, Y) plus to the light absorption layer BS1 formed between the row electrodes X concerned.

On the back surface of the dielectric layer 11, a second additional dielectric layer 12B also extends in parallel to the row direction and protrudes backward from the back surface of the dielectric layer 11 (downward in FIG. 2) in a position opposite to the bus electrode Yb of the row electrode Y, and likewise a third additional dielectric layer 12C extends in parallel to the row direction opposite to an area between the two selective row electrodes Z adjacent to each other.

Additionally, a fourth additional dielectric layer 12D extends in parallel to the column direction on the back surface of the dielectric layer 11 and protrudes backward from the back surface of the dielectric layer 11 (downward in FIGS. 3 and 4) in each position opposite to a mid-area between the transparent electrodes Xa of the row electrode X plus between the transparent electrodes Ya of the row electrode Y which are arranged in the row direction.

A protective layer made of MgO (not shown) covers the back surfaces of the dielectric layer 11, first additional dielectric layer 12A, second additional dielectric layer 12B, third additional dielectric layer 12C, and forth additional dielectric layer 12D.

The front glass substrate 10 is situated in parallel to a back glass substrate 13 having a surface facing the display surface on which a plurality of column electrodes D are arranged parallel to each other at predetermined intervals and each extends in a direction at right angles to the bus electrodes Xb, Yb (in the column direction) in a position opposite to the paired transparent electrodes Xa and Ya of each of the row electrode pairs (X, Y).

On the surface of the back glass substrate 13 on the display surface side, a white column-electrode protective layer (dielectric layer) 14 covers the column electrodes D, and a partition wall 15 shaped as described below are formed on the column-electrode protective layer 14.

The partition wall 15 is constructed by, when viewed from the front glass substrate 10, first transverse walls 15A each of which extends in the row direction in a position opposite the first additional dielectric layer 12A; second transverse walls 15B each of which extends in the row direction in a position opposite the second additional dielectric layer 12B; third transverse walls 15C each of which extends in the row direction in a position opposite the third additional dielectric layer 12C; and vertical walls 15D each of which extends in the column direction in a position opposite the fourth additional dielectric layer 12D.

The first and third transverse walls 15A and 15C, and the vertical wall 15D are each designed to be of a height equal to a distance between the protective layer covering the back surfaces of the first, third and fourth additional dielectric layers 12A, 12C and 12D and the column-electrode protective layer 14 covering the column electrode D. The second transverse wall 15B is designed to be of a height slightly smaller than that of the first and third transverse walls 15A and 15C and vertical wall 15C.

With this design, a leading end face of the first transverse wall 15A (the upper surface in FIG. 2) is in contact with the back surface of the protective layer covering the first additional dielectric layer 12A, and also a leading end face of the third transverse wall 15C is in contact with the back surface of the protective layer covering the third additional dielectric layer 12C.

On the other hand, the second transverse wall 15B is out of contact with the back surface of the protective layer covering the second additional dielectric layer 12B (see FIG. 2), but only the vertical wall 15D intersecting the second transverse wall 15B concerned is in contact with the back surface of the protective layer covering the second additional dielectric layer 12B, so that a clearance r is formed between the leading end face of the second transverse wall 15B and the protective layer covering the second additional dielectric layer 12B and between the adjacent vertical walls 15D.

A leading end face of the vertical wall 15D is in contact with the back surface of the protective layer covering the fourth additional dielectric layer 12D as illustrated in FIGS. 3 and 4.

The partition wall 15 thus designed partitions the discharge space defined between the front and back glass substrates 10 and 13, such that a display discharge cell C1 is formed in a position corresponding to the paired transparent electrodes Xa and Ya facing each other by being surrounded with the first transverse wall 15A, second transverse wall 15B and vertical walls 15D, and a reset and addressing discharge cell C2 is formed in a position corresponding to the selective row electrode Z by being surrounded with the second transverse wall 15B, the third transverse wall 15C and the vertical walls 15D.

The display discharge cell C1 and the reset and addressing discharge cell C2 adjacent to each other with the interposition of the second transverse wall 15B in the column direction are connected with each other through the clearance r which is formed between the leading end face of the second transverse wall 15B and the protective layer covering the second additional dielectric layer 12B.

The two reset and addressing discharge cells C2 adjacent to each other in the column direction with the interposition of the third transverse wall 15C are completely blocked from each other because the leading end face of the third transverse wall 15C is in contact with the protective layer covering the third additional dielectric layer 12C.

A phosphor layer 16 over lies all five faces facing the discharge space in each display discharge cell C1: a face of the column-electrode dielectric layer 14 and the four inner side faces of the first transverse wall 15A, second transverse wall 15B and vertical walls 15D of the partition wall 15. The phosphor layers 16 are arranged in order of a red color, a green color and a blue color along the row direction for each display discharge cell C1.

On the surface of the back glass substrate 13 opposite to each reset and addressing discharge cell C2, a protrusion rib 17 with a height less than that of the second transverse wall 15B protrudes from the surface of the substrate 13 into the reset and addressing discharge cell C2.

Thus, a part of the column electrode D opposite to each reset and addressing discharge cell C2 and the column-electrode protective layer 14 covering the part of column electrode D are raised from the back glass substrate 13 by the protrusion rib 17 to protrude into the corresponding discharge cell C2, and therefore a space-distance s2 between the selective row electrode Z and the part of the column electrode D opposite to the electrode Z concerned with the interposed discharge cell C2 is smaller than a space-distance s1 between part of the column electrode D opposite to the display discharge cell C1 and the transparent electrodes Xa, Ya.

The protrusion rib 17 may be formed of the same dielectric material as that of the column-electrode protective layer 14. Alternatively, the protrusion rib 17 may be constituted by forming projections and depressions on the front surface of the back glass substrate 13 by means of sandblast or wet etching.

Each display discharge cell C1 and each addressing discharge cell C2 are filled with a discharge gas.

Figure 5:
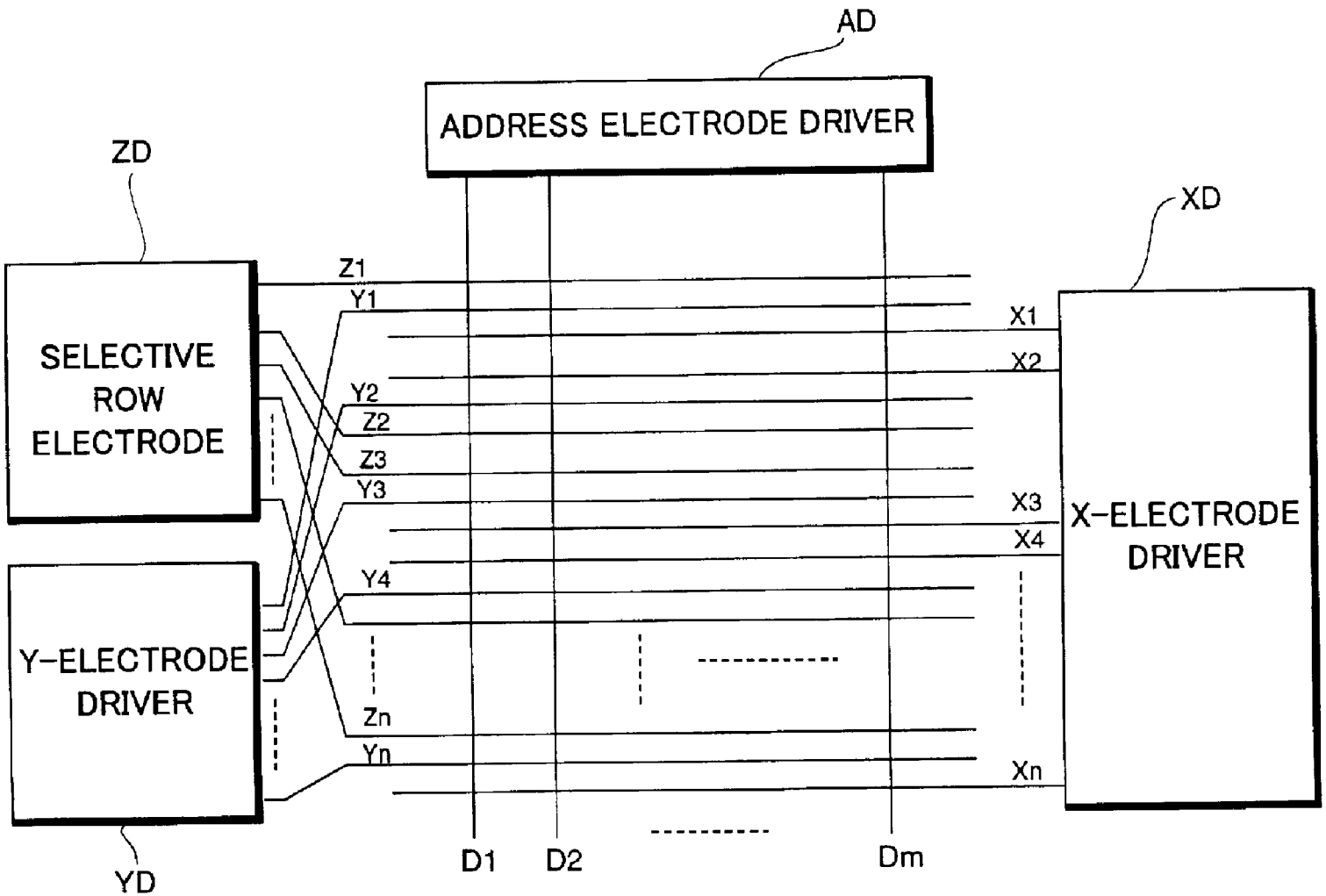
FIG. 5 is a block diagram illustrating the outline of the configuration of a driving unit of a plasma display panel according to the first embodiment.

FIG. 5 is a diagram illustrating the configuration of a driving circuit of the PDP as described above.

In FIG. 5, each of the row electrodes X is connected to a X-electrode driver XD, each of the row electrodes Y to a Y-electrode driver YD, each of the selective row electrodes Z to a selective row electrode driver ZD, and each of the column electrodes D to an address electrode driver AD. Each of the drivers connected to the above electrodes outputs various types of pulses as described later.

Next, a description a method of driving the aforementioned PDP using the driving circuit illustrated in FIG. 5 will be given with reference to the chart of pulse output timing shown in FIG. 6.

Figure 6:
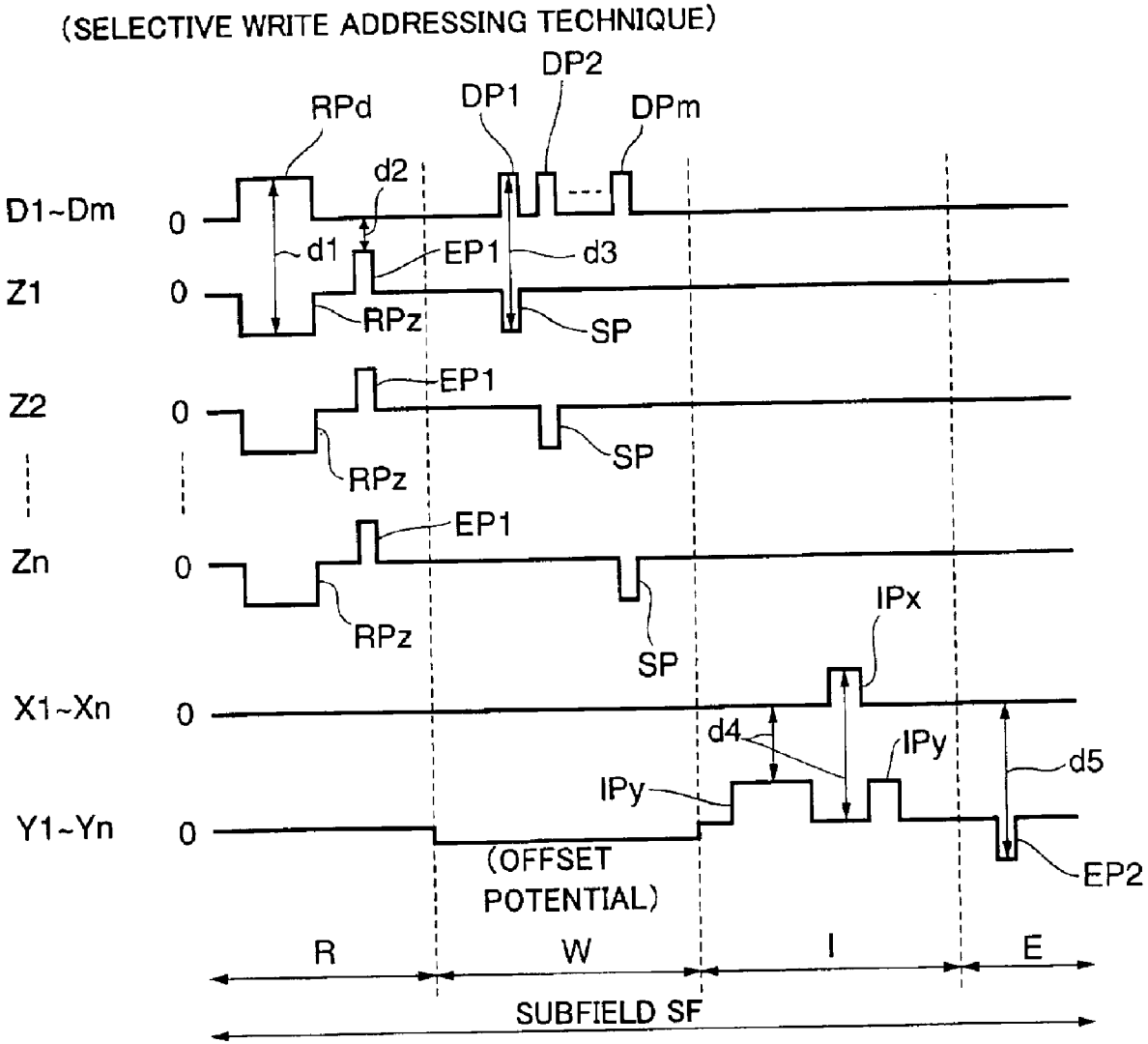
FIG. 6 is a chart representing pulse output timing in an example in the adoption of selective write addressing techniques in the first embodiment of a method of driving the plasma display panel according to the present invention.

FIG. 6 illustrates a chart of pulse output timing in one subfield in a subfield method of dividing one field display period into N subfields, when selective write addressing techniques are adopted.

A discharge period of the subfield SF includes a reset period R, an addressing period W, a sustaining emission period I, and a full-screen erase period E.

In the reset period R, the application of a reset pulse RPd to each of the column electrodes D1 to Dm is performed simultaneously with the application of a reset pulse RPz to each of the selective row electrodes Z1 to Zn, whereupon between the column electrodes D1 to Dm and the selective row electrodes Z1 to Zn respectively opposite to the electrodes D1 to Dm, a full-screen write discharge d1 occur in all of the reset and addressing discharge cells C2 in unison.

Charged particles caused by the full-screen write discharge d1 in each discharge cell C2 pass through the clearance r provided between the second transverse wall 15B and the second additional dielectric layer 12B to flow into a display discharge cell C1 paired with the discharge cell C2 with the interposed second transverse wall 15B. Then, the charged particles form wall charges on the portion of the dielectric layer 11 facing each display discharge cell C1, resulting in the writing to all of the display discharge cells C1.

Immediately following this, an erase pulse EP1 in a polarity opposite to that of the reset pulse RPz is applied to the selective row electrodes Z1 to Zn to produce a potential difference between the electrode Z1–Zn and the corresponding column electrode D1–Dm. A full-screen erase discharge d2 generated by the potential difference transfer through the clearance r into the display discharge cell C1 to erase all of the wall charges existing on the portion of the dielectric layer 11 facing the discharge cell C1.

Next, in the addressing period W, in response to the video signal, data pulses DP1 to DPm are applied to the column electrodes D1 to Dm and sequentially a scan pulse SP is applied to the selective row electrodes Z1 to Zn to cause an addressing discharge d3 within the reset and addressing discharge cells C2 respectively corresponding to the intersections of the column electrodes out of the column electrodes D1–Dm subjected to the data pulses DP1–DPm and the selective row electrodes out of the selective row electrodes Z1–Zn subjected to the scan pulse SP.

Charged particles generated by creating the addressing discharge d3 in each discharge cell C2 pass through the clearance r formed between the second transverse wall 15B and the second additional dielectric layer 12B to flow into the display discharge cell C1 adjacent to the discharge cell C2 concerned with the interposition of the second transverse wall 15B, to thereby form (write) wall charges on the portion of the dielectric layer 11 facing the display discharge cell C1.

In this manner, the display discharge cells C1 in all of the display lines L are grouped into lighted cells having the wall charges formed by creating the addressing discharge d3 in the reset and addressing discharge cells C2 respectively paired with the discharge cells C1 with the interposed second transverse walls 15B (i.e. cells in which write occurs) and non-lighted cells having no wall charges formed because the addressing discharge is not created in the reset and addressing discharge cell C2 paired with the discharge cell C1 (i.e. cells in which write does not occur), for distribution over the panel surface in accordance with an image to be displayed.

In the sustaining emission period I subsequent to the addressing period W, in all of the display lines L, the application of a discharge sustaining pulse IPx to the row electrodes X1 to Xn and the application of a discharge sustaining pulse IPy to the row electrodes Y1 to Yn paired with the corresponding row electrodes X1 to Xn are performed alternately. Every time the discharge sustaining pulse IPx, IPy is applied, a sustaining discharge d4 occurs between the transparent electrodes Xa and Ya facing each other in each lighted cell.

The sustaining discharge generates ultraviolet light. The ultraviolet light excites the red, green or blue phosphor layer 16 facing the display discharge cell C1 to allow it to emit color light to thereby form a display image.

After completion of the addressing period W, in the full-screen erase period E, an erase pulse EP2 in a polarity opposite to that of the discharge sustaining pulse is applied concurrently to the row electrodes Y1 to Yn to cause a full-screen erase discharge d5 between the row electrode Y1–Yn and the corresponding row electrode X1–Xn in order to erase the wall charges remaining.

The aforementioned PDP can also display an image with use of selective erase addressing techniques.

Figure 7:
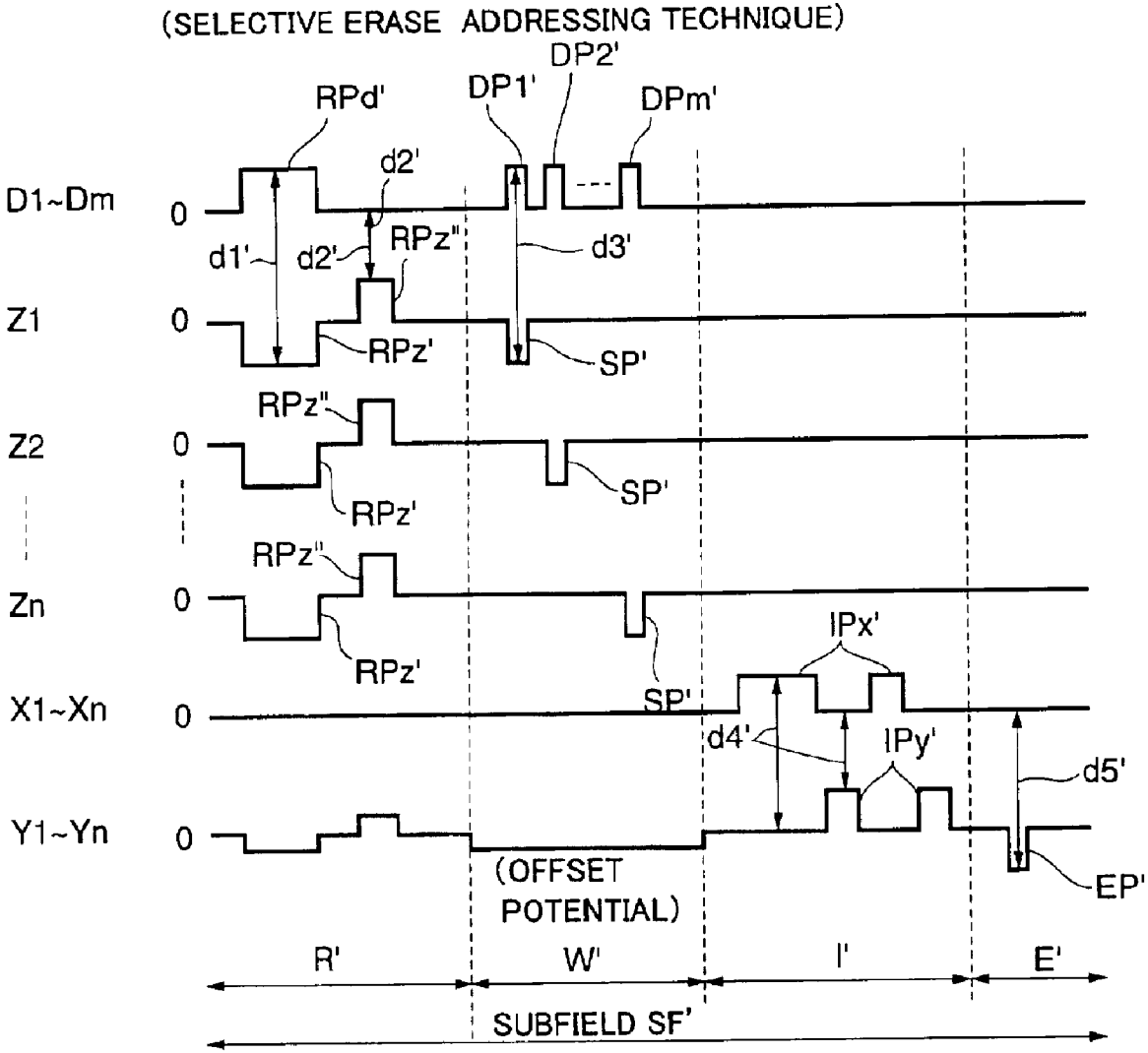
FIG. 7 is chart representing pulse output timing in an example in the adoption of selective erase addressing techniques in the first embodiment of a method of driving the plasma display panel according to the present invention.

FIG. 7 illustrates a chart of pulse output timing in one subfield in a subfield method of dividing one field display period into N subfields, when the selective erase addressing techniques are adopted.

A discharge period of the subfield SF' includes a reset period R', an addressing period W', a sustaining emission period I', and a full-screen erase period E'.

In the reset period R', the application of a reset pulse RPd' to each of the column electrodes D1 to Dm is performed simultaneously with the application of a reset pulse RPz' to each of the selective row electrodes Z1 to Zn, whereupon between the column electrodes D1–Dm and the selective row electrodes Z1–Zn respectively opposite to the electrodes D1–Dm, a full-screen write discharge d1' occur within all of the reset and addressing discharge cells C2 in unison.

Charged particles caused by the full-screen write discharge d1' in each reset and addressing discharge cell C2 pass through the clearance r provided between the second transverse wall 15B and the second additional dielectric layer 12B to flow into a display discharge cell C1 paired with the reset and addressing discharge cell C2 with the interposed second transverse wall 15B. Then, the charged particles form wall charges on the portion of the dielectric layer 11 facing each display discharge cell C1, resulting in the writing to all of the display discharge cells C1.

Immediately following this, a full-screen write pulse RPz" in a polarity opposite to that of the reset pulse RPz' is applied to the selective row electrodes Z1 to Zn to produce a potential difference between the electrode Z1–Zn and the corresponding column electrode D1–Dm. A rewrite discharged 2' generated by the potential difference transfer through the clearance r into the display discharge cell C1 to form adequate wall charges on the portion of the dielectric layer 11 facing the discharge cell C1.

Next, in the addressing period W', in response to a video signal, data pulses DP1' to DPm' are applied to the column electrodes D' to Dm and sequentially a scan pulse SP' is applied to the selective row electrodes Z1 to Zn to cause an addressing discharge d3' in the reset and addressing discharge cells C2 corresponding to the intersections of the column electrodes out of the column electrodes D1–Dm subjected to the data pulses DP L' to DPm' and the selective row electrodes out of the selective row electrodes Z1–Zn subjected to the scan pulse SP'.

Charged particles caused by the addressing discharge d3' in the reset and addressing discharge cell C2 pass through the clearance r formed between the second transverse wall 15B and the second additional dielectric layer 12B to flow into the display discharge cell C1 paired with the reset and addressing discharge cell C2 concerned with the interposed second transverse wall 15B, to thereby erase the wall charges existing on the portion of the dielectric layer 11 facing the display discharge cell C1.

In this manner, the display discharge cells C1 in all of the display lines L are grouped into non-lighted cells in which the wall charges are erased by creating the addressing discharge d3' in the reset and addressing discharge cell C2 paired with the display discharge cell C1 with the interposed second transverse wall 15B, and lighted cells in which the wall charges are not erased because the addressing discharge does not occur in the discharge cell C2 paired with the discharge cell C1, for distribution over the panel surface in accordance with an image to be displayed.

In the sustaining emission period I' subsequent to the addressing period W', in all of the display lines L, the application of a discharge sustaining pulse IPx' to the row electrodes X1 to Xn and the application of a discharge sustaining pulse IPy' to the row electrodes Y1 to Yn paired with the electrodes X1 to Xn are performed alternately. Every time the discharge sustaining pulse IPx', IPy' is applied, a sustaining discharge d4' occurs between the transparent electrodes Xa and Ya facing each other in each lighted cell.

The sustaining discharge generates ultraviolet light. The ultraviolet light excites the red, green or blue phosphor layer 16 facing each of the display discharge cells C1 to allow it to emit color light to thereby form a display image.

After completion of the sustaining emission period I', in the full-screen erase period E', an erase pulse EP in a polarity opposite to that of the discharge sustaining pulse is applied concurrently to the row electrodes Y1 to Yn to cause a full-screen erase discharge d5' between the row electrode Y1–Yn and the corresponding row electrode X1–Xn in order to erase the wall charges remaining.

Figure 8:
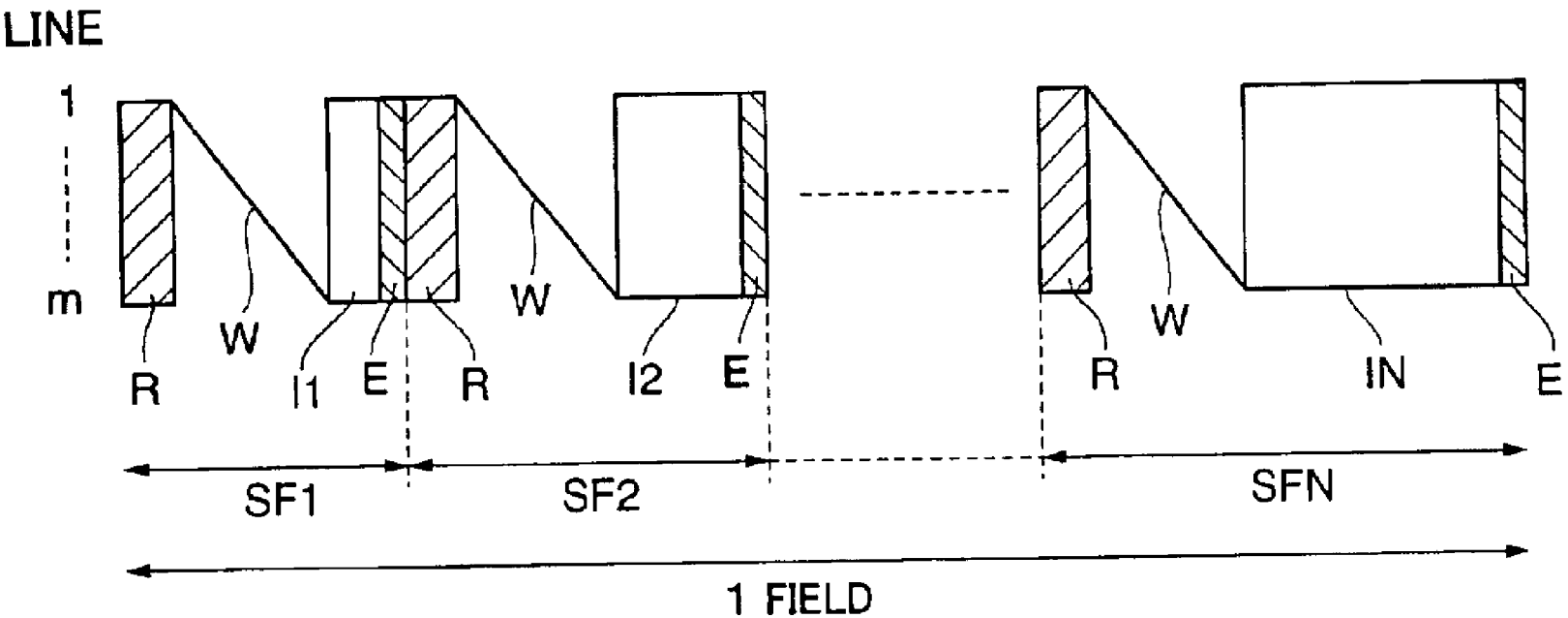
FIG. 8 is a diagram representing an example of light-emission drive formats in the method of driving the plasma display panel in the first embodiment.

FIG. 8 is a diagram illustrating a light-emission driving format in the subfield method for the aforementioned PDP.

In FIG. 8, one field display period is divided into N subfields. Each of the subfields SF1 to SFN includes a reset period R, an addressing period W, a sustaining emission period I, and a full-screen erase period E as described earlier. Each of the sustaining emission periods I1 to IN in the respective subfields SF1 to SFN is established in association with weight of the corresponding subfield.

In this manner, the aforementioned PDP is designed such that the display discharge cell C1 experiencing the sustaining discharge d4, d4' is provided separately from the reset and addressing discharge cell C2 experiencing the reset discharge (i.e. the full-screen write discharge d1, the full-screen erase discharge d2, the full-screen write discharge d1' and the rewrite discharge d2'), the addressing discharge d3, d3'. Further, the light emission generated by the reset discharge and the addressing discharge in the reset and addressing discharge cell C2 is absorbed by the light absorption layer BS2 covering the display surface side of the reset and addressing discharge cell C2 to prevent from leaking toward the display surface of the front glass substrate 10. With this design, there is no likelihood that the light emission caused by the rest discharge and the addressing discharge adversely affects an image generated by the sustaining discharge caused in the display discharge cells C1.

Except that a reset and addressing discharge cell C2 is connected to the display discharge cell C1 paired therewith through the clearance r provided between the second additional dielectric layer 12B and the second transverse wall 15B, the discharge cell C2 is completely blocked from other reset and addressing discharge cells C2 adjacent to the reset and addressing discharge cell C2 concerned in the row direction and the column direction because of contact established between the protective layer covering the third additional dielectric layer 12C and the third transverse wall 15C and between the protective layer covering the fourth additional dielectric layer 12D and the vertical wall 15D.

For this reason, there is no likelihood that the charged particles caused by the reset discharge and the addressing discharge in a reset and addressing discharge cell C2 accidentally flow into other unconnected reset and addressing discharge cells C2.

Further, the foregoing PDP is also designed such that the reset discharge and the addressing discharge are caused by use of the selective row electrode Z provided on a position opposite the column electrode D with the reset and addressing discharge cell C2 in between and formed separately from the row electrodes X, Y. Therefore, it becomes unnecessary to output a discharge sustaining pulse by way of the scan-pulse generation driver for the addressing discharge as in the prior art cases of using the same row electrode for causing the reset discharge, the addressing discharge and the sustaining discharge.

Due to such design, the PDP according to the present invention does not require a high-performance scan-pulse generation driver and also the panel construction does not need adaptation to dissipation of heat produced by using the high-performance scan-pulse generation driver. Further a high-performance switch circuit for separation between a reset-pulse generation circuit and a discharge-sustaining-pulse generation circuit is not required. Thus, the configuration of the driving circuit and the panel construction are advantageously simplified to reduce costs of the products.

Still further, in the aforementioned PDP, the reset discharge and the addressing discharge are caused in the reset and addressing discharge cell C2 having no phosphor layer formed therein. Therefore, the reset discharge and the addressing discharge occur stably without being subject to various influences of discharge properties differing among phosphor materials of the primary colors forming the phosphor layer, of variations in thickness of the phosphor layer, and the like, as in the cases in the prior art PDPs in which the reset discharge and the addressing discharge are created across a discharge cell with the inter position of the phosphor layer.

Another advantage of the aforementioned PDP is a reduction in the discharge starting voltage of the reset discharge and the addressing discharge because a portion of the column electrode D facing the reset and addressing discharge cell C2 in which the reset discharge and addressing discharge are caused between the portion of the electrode D and the selective row electrode Z, is protruded inward the reset and addressing discharge cell C2 by the protrusion rib 17 to shorten the space-distance s2 between the electrodes D and the electrode Z.

Yet another advantage of the foregoing PDP achieves improvement in luminous efficiency for an image display because the discharge space in the display discharge cell C1 can be designed to be large (i.e. an increase of the space-distance s1 between the transparent electrode Xa, Ya and the column electrode D) regardless of the reset discharge and the addressing discharge caused in the reset and addressing discharge cell C2.

Still further, the panel surface of the aforementioned PDP includes a non-display area in which light emission for image display is not generated, in addition to the light emission area provided opposite the display discharge cells C1 for light emission for image display. The non-display area is covered with the black-colored bus electrodes Xb, Yb of the respective row electrodes X, Y and the light absorption layers BS1, BS2, which therefore absorbs ambient light incident upon the panel surface for prevention of the reflection of the incoming ambient light. As a result, the image is prevented from being adversely affected by the reflection of the ambient light.

The foregoing first embodiment describes the clearance r provided between the second additional dielectric layer 12B and the second transverse wall 15B decreased in height to establish a communication between the display discharge cell C1 and the reset and addressing discharge cell C2 which are paired with each other with the inter position of the second transverse wall 15B. However, the communication between the paired cells C1 and C2 can be established by employing another manner: for example, a groove being provided in the top portion of a second transverse wall having the same height as that of the first transverse wall 15A to extend between the display discharge cell C1 and the corresponding reset and addressing discharge cell C2; a groove being provided in an additional dielectric layer in contact with a second transverse wall having the same height as that of the first transverse wall 15A to extend between the display discharge cell C1 and the corresponding reset and addressing discharge cell C2; or alternatively, a second transverse wall having the same height as that of the first transverse wall 15A being positionally staggered from an additional dielectric layer to form a clearance extending between a display discharge cell C1 and the corresponding reset and addressing discharge cell C2.

Figure 9:
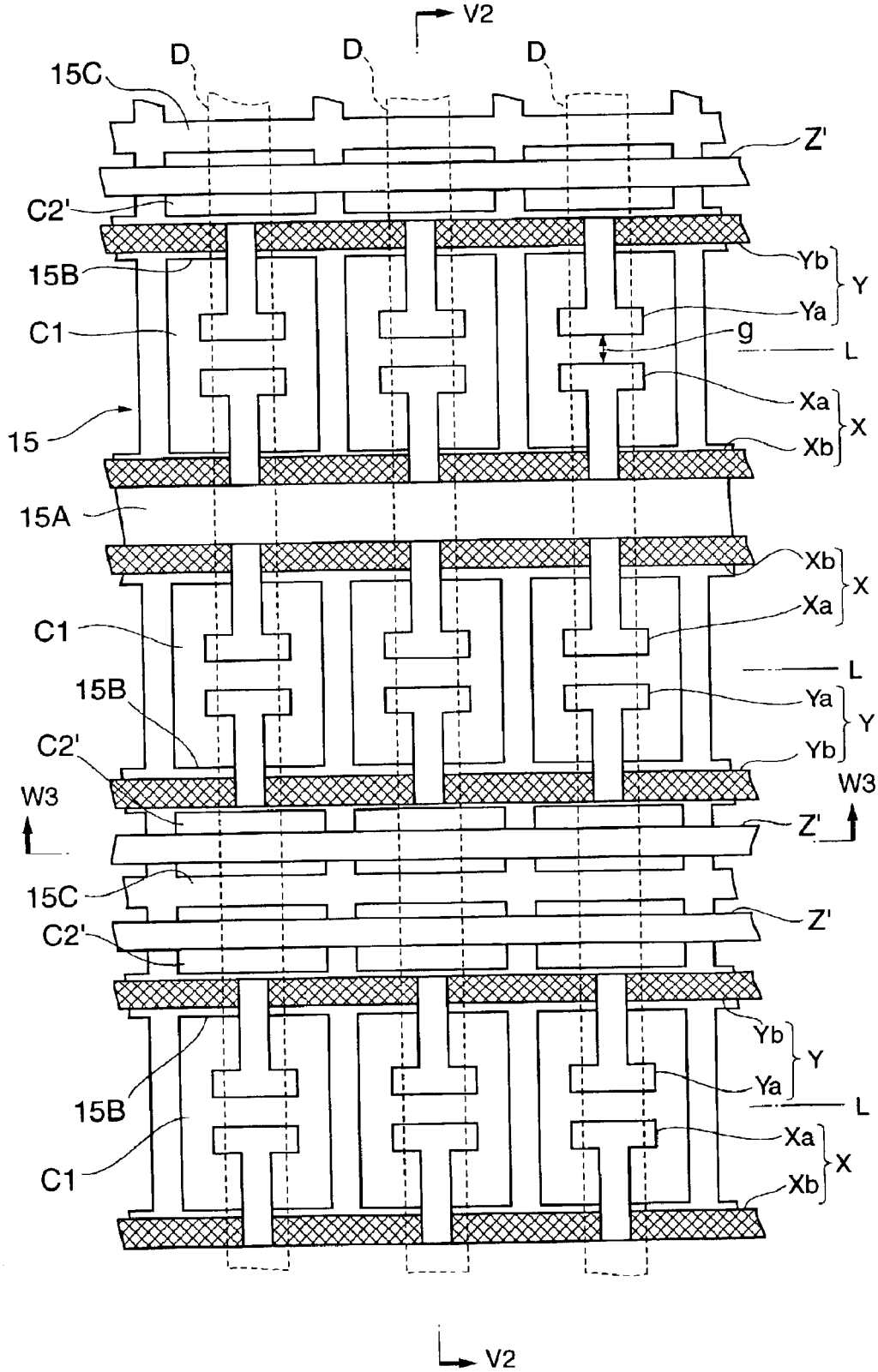
FIG. 9 is a schematic front view illustrating a second embodiment according to the present invention.
Figure 10:
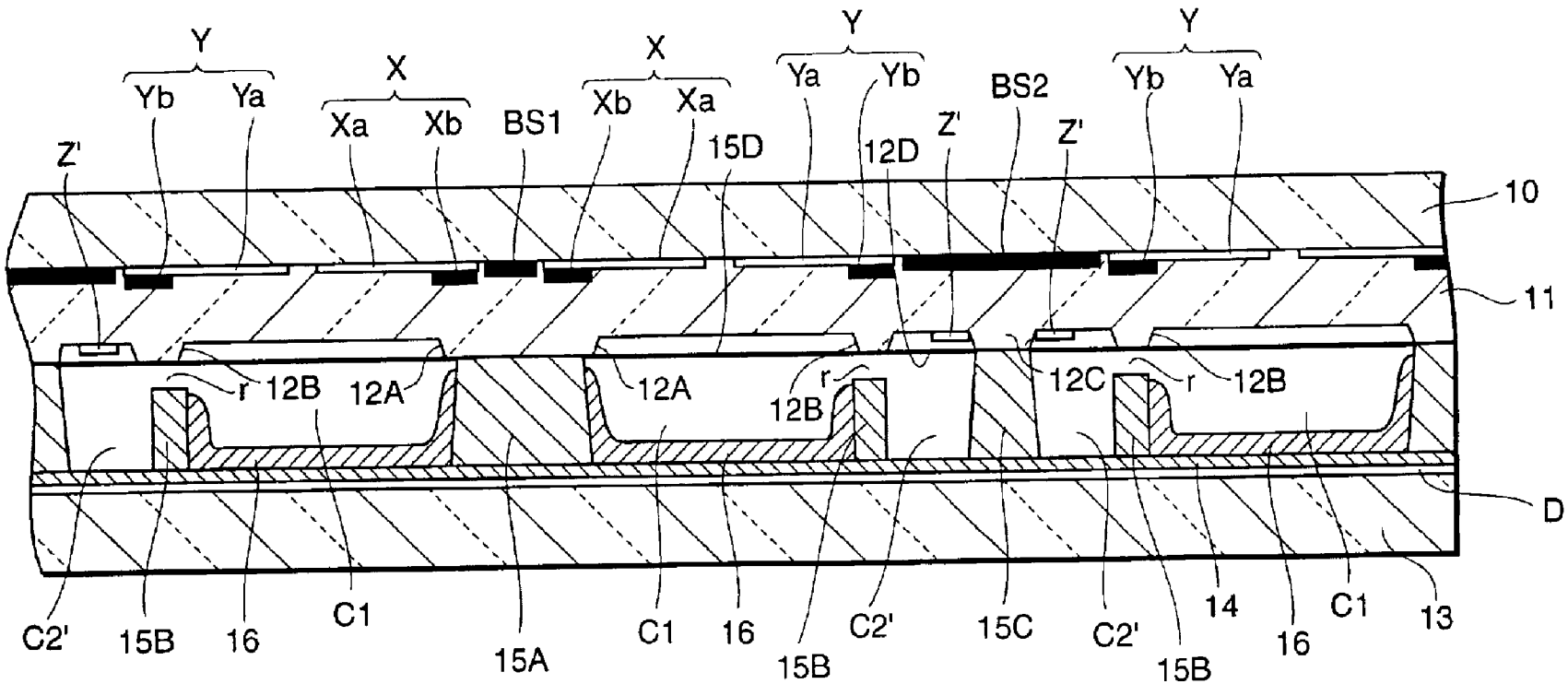
FIG. 10 is a sectional view taken along the V2—V2 line in FIG. 9.
Figure 11:
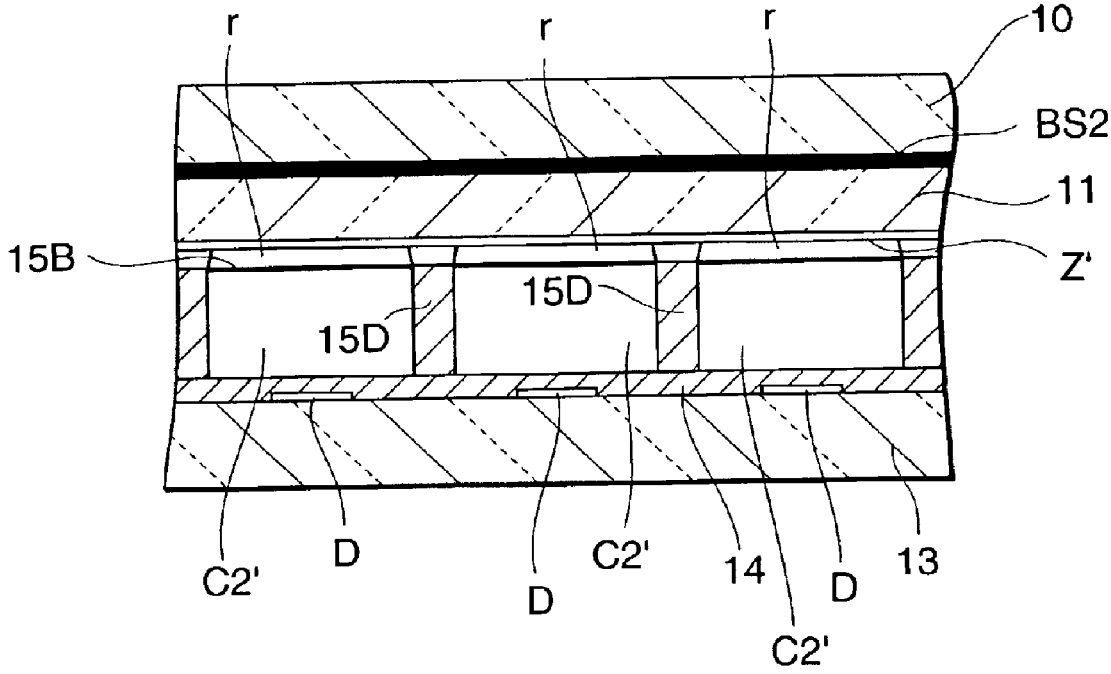
FIG. 11 is a sectional view taken along the W3—W3 line in FIG. 9.

FIG. 9 to FIG. 11 are schematic views illustrating a second embodiment of the PDP according to the present invention, FIG. 9 being a front view illustrating part of the cell construction of the PDP, FIG. 10 being a sectional view taken along the V2—V2 line of FIG. 9, and FIG. 11 being a sectional view taken along the W3—W3 line of FIG. 9.

The PDP in the first embodiment includes the selective row electrode z provided between the light absorption layer BS2 formed on the back surface of the front glass substrate 10 and the dielectric layer 11 positioned just behind the layer BS2 concerned, whereas the PDP in the second embodiment includes a selective row electrode Z' provided between the dielectric layer 11 and a protective layer (not shown) formed on the back surface of the layer 11 concerned.

The PDP in the second embodiment is not provided with the protrusion rib 17 which is provided in the PDP in the first embodiment.

The configuration of other components in the second embodiment is the same as those of the PDP in the first embodiment, and the same reference numerals as those in the first embodiment are used.

As in the PDP in the first embodiment, the PDP in the second embodiment is designed such that a reset discharge and an addressing discharge are caused between the selective row electrode Z' and the column electrode D within the reset and addressing discharge cell C2' formed separately from the display discharge cell C1. The PDP in the second embodiment is driven in a method similar to that in the PDP in the first embodiment. The selective row electrode Z' is provided on the back surface of the dielectric layer 11 in a position close to the reset and addressing discharge cell C2' to be located in the adequate proximity of the column electrode D. Therefore, it is possible to reduce a discharge starting voltage for the reset discharge and the addressing discharge without the protrusion rib 17 provided as that in the PDP in the first embodiment.

Figure 12:
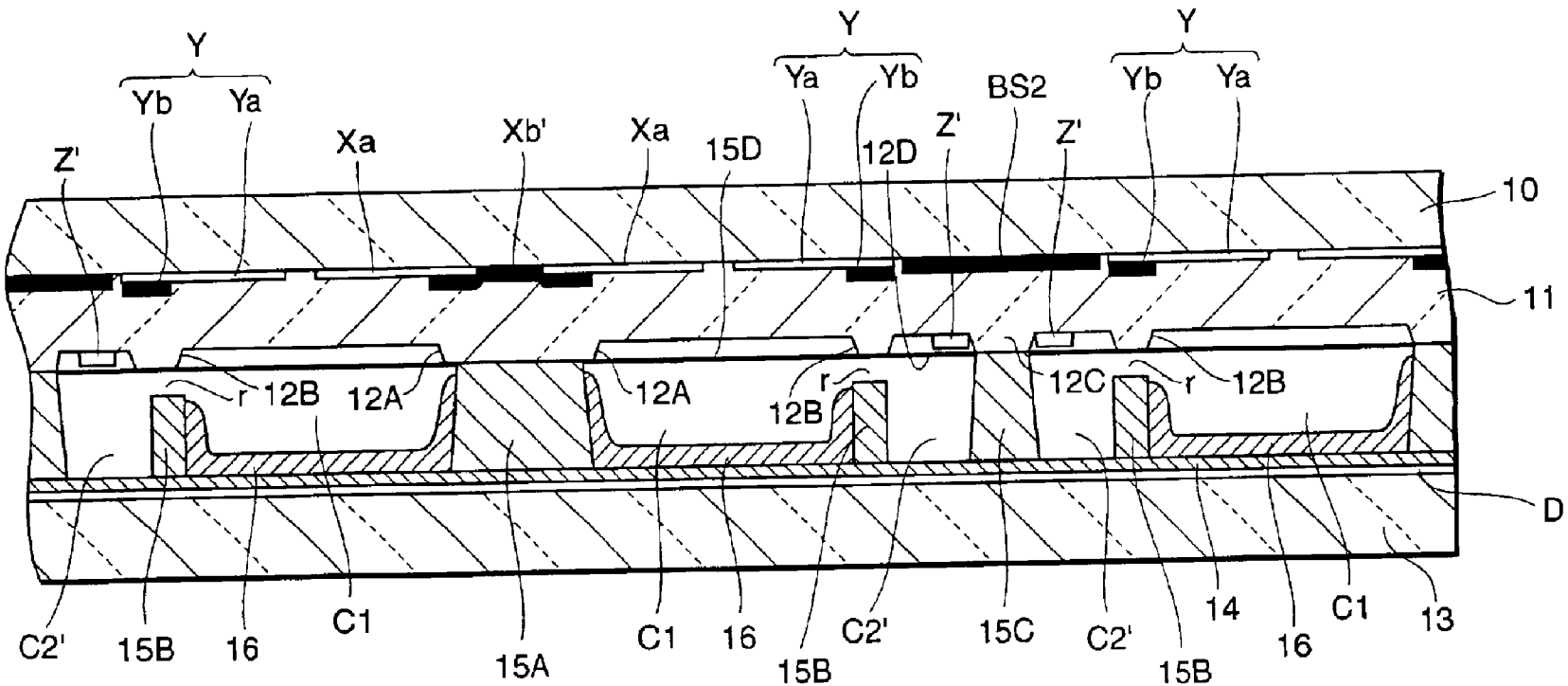
FIG. 12 is a schematic sectional view of a third embodiment according to the present invention.

FIG. 12 is a sectional view illustrating a third embodiment of the PDP according to the present invention, which is taken along the same position as that in FIG. 10 of the second embodiment.

The PDP in the third embodiment is designed such that the transparent electrodes Xa of the two row electrodes X positioned back to back in between adjacent display lines L are connected to a single black-colored bus electrode Xb' formed opposite the full leading end face (the upper face in FIG. 12) of the first transverse wall 15A of the partition wall 15 to share the use of the bus electrode Xb', and the bus electrode Xb' covers the leading end face of the first transverse wall 15A when viewed from the front glass substrate 10.

In FIG. 12, the configuration of other components in the third embodiment is the same as those of the PDP in the first and second embodiments, and the same reference numerals as those in the first and second embodiments are used.

The PDP of the third embodiment is driven in a method similar to that in the PDP of the first and second embodiments. The third embodiment does not require to especially provide the light absorption layer BS1 for absorption of ambient light as provided in the PDP of the first and second embodiment because the black-colored bus electrode Xb' covers the leading end face of the first transverse wall 15A.

Figure 13:
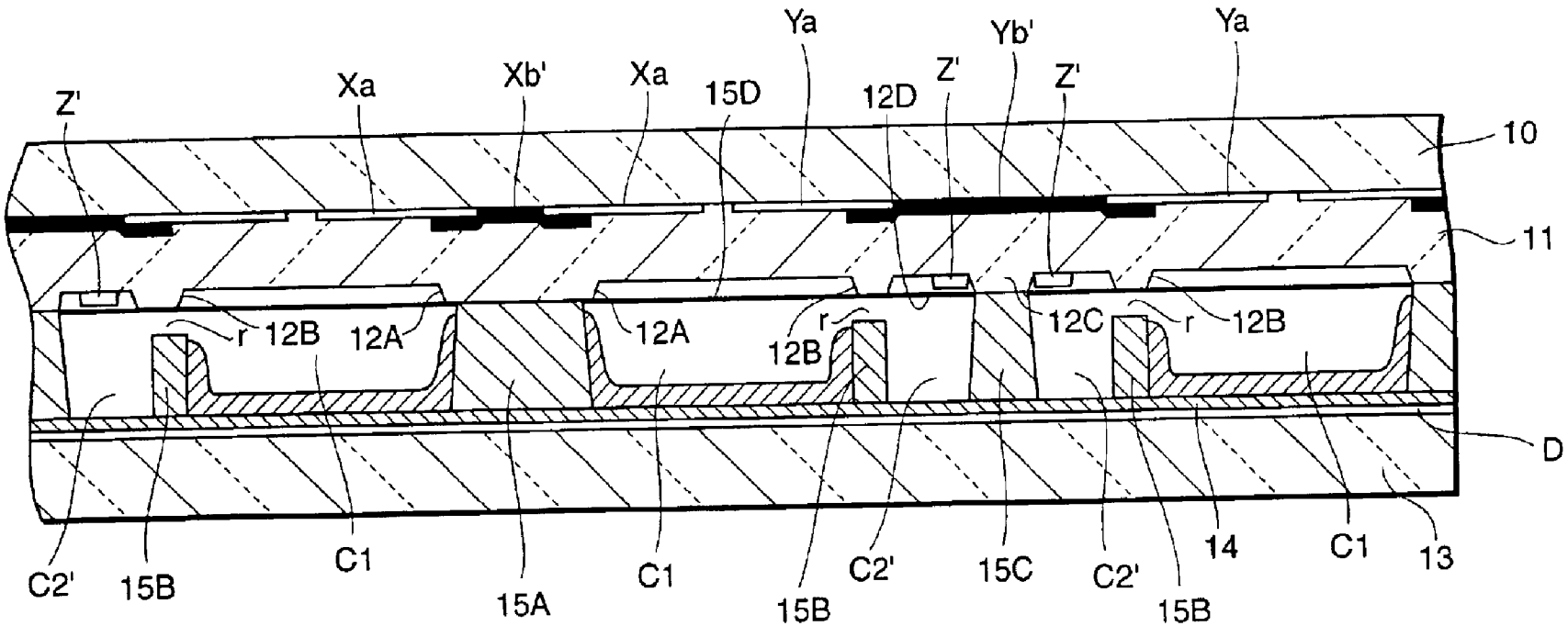
FIG. 13 is a schematic front view of a fourth embodiment according to the present invention.
Figure 14:
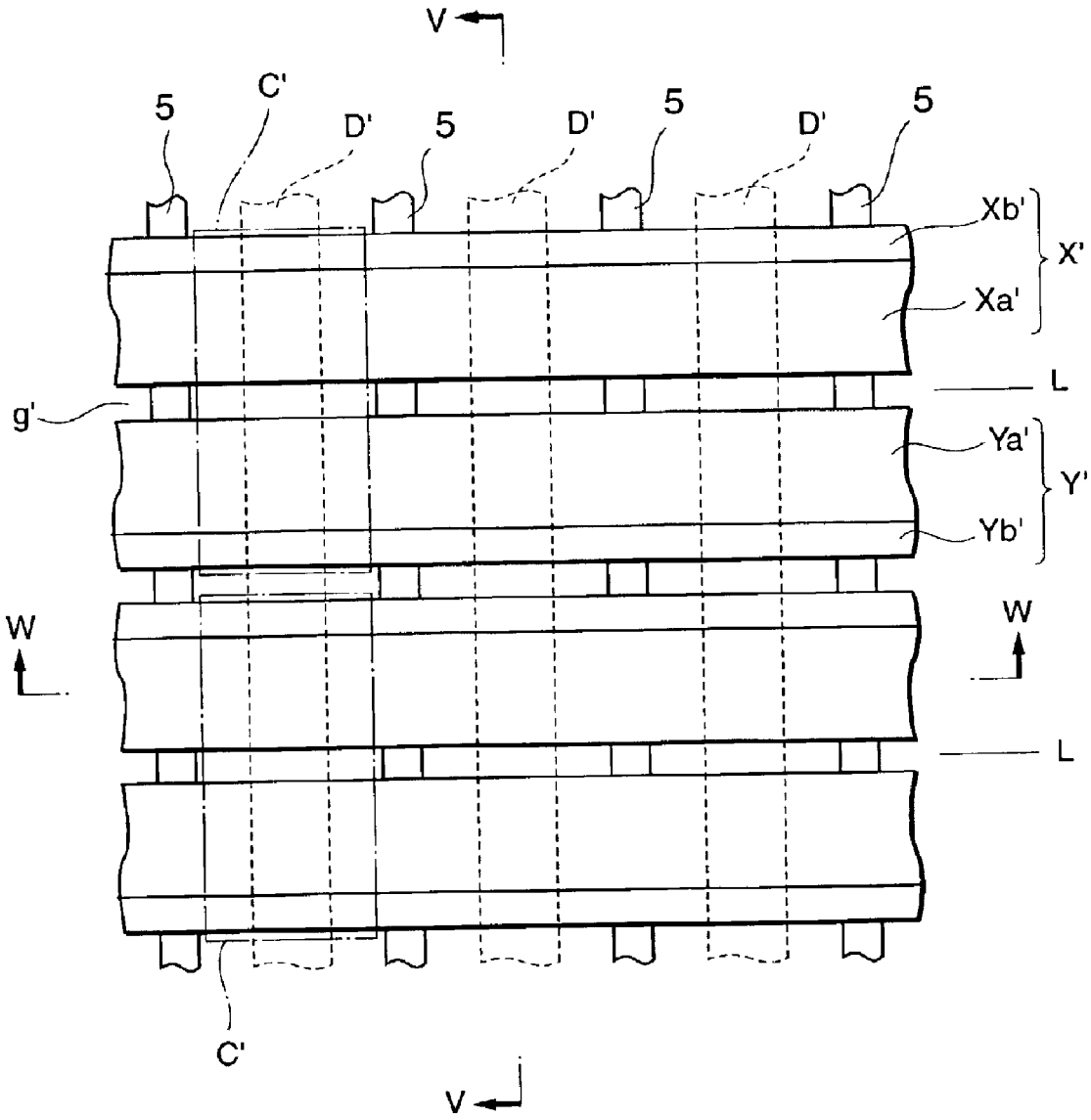
FIG.14 PRIOR ART
FIG. 14 is a schematic front view of a construction of a prior art PDP.
Figure 15:
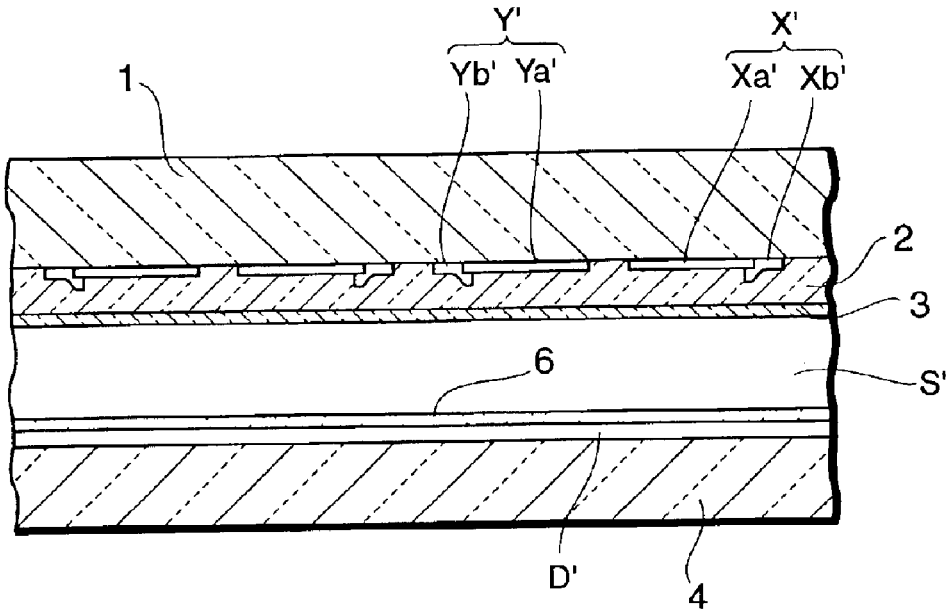
FIG.15 PRIOR ART
FIG. 15 is a sectional view taken along the V—V line in FIG. 14.
Figure 16:
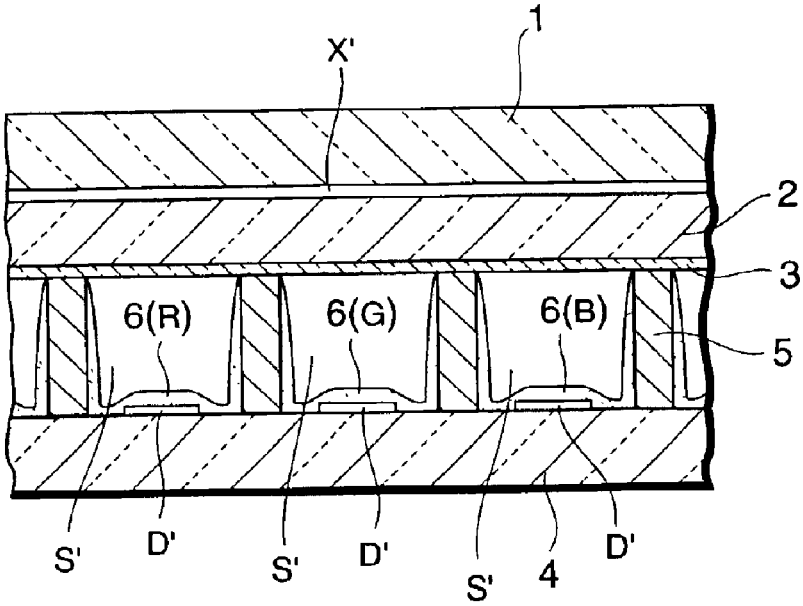
FIG.16 PRIOR ART
FIG. 16 is a sectional view taken along the W—W line in FIG. 14.

FIG. 13 is a sectional view illustrating a fourth embodiment of the PDP according to the present invention, which is taken along the same position as that in FIG. 10 in the second embodiment.

The PDP in the fourth embodiment is designed, in addition to the construction of the third embodiment, such that the transparent electrodes Ya of the two row electrodes Y positioned back to back in between adjacent display lines L are connected to a single black-colored bus electrode Yb' formed opposite the leading end faces (the upper face in FIG. 13) of the two second transverse walls 15B and third transverse wall 15C of the partition wall 15 and the two reset and addressing discharge cells C2' adjacent to each other in the column direction, to share the use of the bus electrode Yb'.

The bus electrode Yb' covers all of the leading end faces of the two second transverse walls 15B and third transverse wall 15C of the partition wall 15 and the two reset and addressing discharge cells C2' adjacent to each other in the column direction when viewed from the front glass substrate 10.

In FIG. 13, the configuration of other components in the fourth embodiment is the same as those of the PDP in the first, second and third embodiments, and the same reference numerals as those in the first, second and third embodiments are used.

The PDP in the fourth embodiment is driven in a method similar to that in the PDP in the first, second and third embodiments. The fourth embodiment does not require to especially provide the light absorption layer BS2 for absorption of ambient light and light emission generated by the reset discharge and the addressing discharge as provided in the PDP in the first, second and third embodiments because the black-colored bus electrode Yb' covers the leading end faces of the two second transverse walls 15B and third transverse wall 15C and the two reset and addressing discharge cells C2' adjacent to each other in the column direction. Further, the shared use of the bus electrode Yb' decreases impedance of the row electrode Y.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including a front substrate, a back substrates opposite the front substrate with a discharge space interposed between the front and back substrates, a plurality of row electrode pairs regularly arranged in a column direction on a back surface of the front substrate and each extending in a row direction to form a display line and being constituted by two row electrodes, a dielectric layer covering the row electrode pairs on the back surface of the front substrate, and a plurality of column electrodes regularly arranged in the row direction on a surface of the back substrate facing the front substrate and each extending in the column direction to intersect the row electrode pairs and form unit light-emitting areas in the discharge space at the respective intersections, said plasma display panel comprising:

a selective row electrode extending in the row direction in a position between the row electrode pairs adjacent to each other in the column direction on the back surface of said front substrate;

a partition wall surrounding each of said unit light-emitting areas to define the unit light-emitting areas;

a dividing wall provided for dividing each of said unit light-emitting areas into a first discharge area provided opposite face-to-face parts of the respective row electrodes constituting each row electrode pair for a discharge to be caused between the row electrodes, and a second discharge area provided opposite a portion of said selective row electrode intersecting with the column electrode for a discharge to be caused between the selective row electrode and the column electrode; and a communication element provided between said first discharge area and said second discharge area for communication from the second discharge area to the first discharge area.

2. The plasma display panel according to claim 1, further comprising a black- or dark-colored light absorption layer provided on a portion of said front substrate opposite each of said second discharge areas.

3. The plasma display panel according to claim 1, further comprising a phosphor layer provided only in each of said first discharge areas for emitting light by means of the discharge.

4. The plasma display panel according to claim 1, wherein said communication element comprises a clearance formed between the front substrate and the dividing wall by determining a height of the dividing wall dividing off said first discharge area and said second discharge area to be less than a height of said partition wall for defining the periphery of each unit light-emitting area.

5. The plasma display panel according to claim 1, wherein said communication element comprises a groove formed in the dividing wall dividing off said first discharge area and said second discharge area, and having both ends opening toward the first discharge area and the second discharge area.

6. The plasma display panel according to claim 1, wherein said partition wall comprises transverse walls and vertical walls, further comprising additional elements jutting out from portions of said dielectric layer opposite the transverse wall for a partition between the adjacent unit light-emitting areas in the column direction and the vertical wall for a partition between the adjacent unit light-emitting areas in the row direction, toward the discharge space to come in contact with the transverse wall and the vertical wall of the partition wall in the vicinity of at least said second discharge area of each unit light-emitting area to block the second discharge area concerned from a unit light-emitting area adjacent thereto.

7. The plasma display panel according to claim 1, further comprising a protrusion element provided between the back substrate and the column electrode and protruding from a portion of the back substrate facing to said second discharge area into the second discharge area in the direction of the front substrate, to allow a part of the column electrode opposite the second discharge area to jut out in the direction of said selective row electrode formed on the front substrate.

8. The plasma display panel according to claim 1 wherein said selective row electrode is formed on a portion of the back surface, facing said second discharge area, of the dielectric layer covering the row electrode pairs.

9. A method of driving a plasma display panel including:

a plurality of row electrode pairs regularly arranged on a back surface of a front substrate in a column direction and each extending in a row direction to form a display line;

a dielectric layer covering the row electrode pairs on the back surface of the front substrate;

a selective row electrode provided between the row electrode pairs adjacent to each other in the column direction on the back surface of the front substrate and extending in the row direction;

a plurality of column electrodes regularly arranged in the row direction on a surface of a back substrate facing the front substrate with a discharge space in between, and each extending in the column direction to intersect the row electrode pairs and form unit light-emitting areas in the discharge space at the respective intersections;

a partition wall provided around each of the unit light-emitting areas to define the unit light-emitting areas;

a dividing wall provided for dividing each of the unit light-emitting areas into a first discharge area provided opposite face-to-face parts of the respective row electrodes constituting each of the row electrode pairs for a discharge caused between the row electrodes, and a second discharge area provided opposite a portion of the selective row electrode intersecting with the column electrode for a discharge caused between the selective row electrode and the column electrode; and a communication element provided between the first discharge area and the second discharge area for communication from the second discharge area to the first discharge area, said method of driving the plasma display panel comprising the steps of:

selectively causing an addressing discharge between the selective row electrode and the column electrode within the second discharge area to cause charged particles to form wall charges on the dielectric layer or to erase wall charges existing on the dielectric layer; and causing a sustaining discharge between the row electrode pair within the first discharge area for light emission after the charged particles caused by the addressing discharge within the second discharge area are introduced through the communication element into the first discharge area to form the wall charges on a portion of the dielectric layer facing the first discharge area or to erase the wall charges existing thereon.

10. The method of driving the plasma display panel according to claim 9, further comprising the step of causing a reset discharge between the selective row electrode and the column electrode in each of the second discharge areas to cause charged particles to form wall charges on the dielectric layer or to erase wall charges existing on the dielectric layer, wherein the addressing discharge is produced in the second discharge area after the charged particles generated in the second discharge area by creating the reset discharge are introduced into the first discharge area through the communication element to form the wall charges on a portion of the dielectric layer facing the first discharge area concerned or to erase the wall charges existing thereon.

* * * * *